US006881055B2

(12) United States Patent
Bird

(10) Patent No.: US 6,881,055 B2
(45) Date of Patent: Apr. 19, 2005

(54) TEMPERATURE CONTROLLED BURNER APPARATUS

(75) Inventor: Douglas D. Bird, Little Canada, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/410,765

(22) Filed: Apr. 10, 2003

(65) Prior Publication Data

US 2004/0202975 A1 Oct. 14, 2004

(51) Int. Cl.[7] ..... F23N 5/10

(52) U.S. Cl. ..... 431/80; 431/86; 431/281; 126/19 M; 126/39 G; 126/39 BA; 126/273 R; 236/15 A; 236/15 BG

(58) Field of Search ..... 126/39 BA, 39 C, 126/39 G, 19 M, 273 R; 431/12, 80, 275, 281, 86, 278; 236/15 A, 15 BG; 137/498

(56) References Cited

U.S. PATENT DOCUMENTS

| | | | | | |
|---|---|---|---|---|---|
| 3,556,129 | A | * | 1/1971 | Brown | 137/271 |
| 3,896,857 | A | | 7/1975 | Turner et al. | 137/628 |
| 4,521,183 | A | * | 6/1985 | Hirai et al. | 432/37 |
| 4,549,571 | A | * | 10/1985 | Kelly | 137/489.5 |
| 4,626,197 | A | | 12/1986 | Kumazawa et al. | 431/302 |
| 4,850,530 | A | * | 7/1989 | Uecker | 236/1 EB |
| 4,930,488 | A | * | 6/1990 | Pearman et al. | 126/39 E |
| 5,003,960 | A | | 4/1991 | Hanagan | 126/39 |
| 5,033,449 | A | | 7/1991 | Hanagan | 126/39 BA |
| 5,127,824 | A | * | 7/1992 | Barker | 431/284 |
| 5,176,358 | A | | 1/1993 | Bonne et al. | 251/30.05 |
| 5,215,115 | A | | 6/1993 | Dietiker | 137/492.5 |
| 5,323,999 | A | | 6/1994 | Bonne et al. | 251/11 |
| 5,441,597 | A | | 8/1995 | Bonne et al. | 216/2 |
| 5,628,242 | A | | 5/1997 | Higley | 99/332 |
| 5,813,394 | A | | 9/1998 | Clifford | 126/41 |
| 5,975,072 | A | | 11/1999 | Garceau et al. | 126/39 |
| 5,975,884 | A | * | 11/1999 | Dugger | 431/42 |
| 6,488,022 | B1 | * | 12/2002 | Shingler | 126/41 R |

* cited by examiner

*Primary Examiner*—Ira S. Lazarus
*Assistant Examiner*—James G. Barrow
(74) *Attorney, Agent, or Firm*—Gregory M. Ansems

(57) ABSTRACT

A system for controlling temperature in an enclosure operates in a low heat or a high heat mode with flame always present. The presently intended use is for providing a cooking grill with a controlled temperature cooking space. An electrically controlled valve having high flow rate and low flow rate settings is interposed in the fuel line for at least one of the burners in the grill. A temperature sensor signals cooking space temperature to a controller that may be a microprocessor. The system includes a keyboard allowing the user to communicate a selected set point to the microprocessor and the microprocessor communicates status to a display. The microprocessor selects the setting of the electrically controlled valve. In a preferred embodiment, the electrically controlled valve is placed in series fuel flow with one of the manually adjustable valves commonly found on cooking grills.

16 Claims, 2 Drawing Sheets

TEMPERATURE CONTROLLED BURNER APPARATUS

CROSS REFERENCE TO RELATED APPLICATION

A related application (hereafter, the Munsterhuis application) is entitled "Diaphragm-Operated Fluid Flow Control Valve Providing a Plurality of Flow Levels", is filed on the same date as this application by Wim Munsterhuis, and has a common assignee with this application.

BACKGROUND OF THE INVENTION

The gas grill is a well-known home appliance. A gas grill typically includes an enclosure having a base portion mounted on a support frame. A cooking grate for supporting food to be cooked is mounted near the top of the base portion. Burner elements are mounted beneath the grate. A clamshell cover is hinged along the back edge of the base portion and designed to mate with the base portion, so that the cover can be lowered to define and enclose a cooking space and lifted to allow access to food cooking on the grate.

If the grill uses LP gas for fuel, a support frame fixed to the grill holds the common LP (propane) gas tank. The support frame has a bracket for holding the gas tank in a fixed position and that allows detaching an empty tank from and attaching a fill replacement to a gas supply hose. Grills having gas tanks typically include wheels to allow for easily moving the grill about. Other types of gas grills have a permanent natural gas connection for fuel, and this invention can be used in them also.

Regardless of the type of fuel source, these grills include a pressure regulator immediately connected to the gas supply hose to receive fuel from the fuel source. The pressure regulator reduces the fuel source pressure to a level suitable for grill operation. A set of manually operated valves receives fuel from the regulator. The manually operated valves provide for adjusting cooking temperature by controlling flow rate of fuel to the burner elements from the regulator. Usually, an igniter is provided to start the initial flame. All this is of course well known to most grill users.

Gas grills are primarily used for cooking food such as meats and vegetables. The gas grill is less well suited however, to cook or bake other types of foods such as breads, pizza, casseroles, and pastries because temperature control is imprecise. Most grills have a thermometer so one can get a rough idea of the cooking space temperature. But many things affect cooking space temperature. Of course, the cook will open the cover occasionally to check on the progress of the cooking process. Wind and precipitation can affect the cooking space temperature.

At the present time, the chef manually adjusts the fuel valves to approximate settings to create the temperature needed for the particular food to be cooked. If conscientious, she or he will periodically check the grill thermometer and further adjust the fuel valves to more closely hold the desired temperature setting. This is a bother, and provides poor temperature control as well. Not only that, but every time the top is opened to check on the food or to turn it, the enclosure temperature falls dramatically. Substantial time may pass before the cooking space temperature returns to the desired level.

This state of affairs has limited the usage of gas grills and has resulted on occasion in undesirable cooking results when using gas grills.

BRIEF DESCRIPTION OF THE INVENTION

We have developed a temperature control system for gas grills and other types of fuel burners. When used with gas grills, the system provides quite accurate control of the grill enclosure temperature while the cover is closed.

Such a control system for a fluid fuel burner supplying heat to an enclosure includes a temperature sensor mounted within the enclosure for sensing the temperature within the enclosure and providing a temperature signal encoding the temperature within the enclosure. An electrically controlled fuel valve is interposed in the fuel line for controlling flow of fuel from the fitting to the fuel burner. The fuel valve has at least first and second preselected fuel flow rates responsive respectively to corresponding at least first and second states of a fuel rate signal. The second fuel flow rate is higher than the first fuel flow rate.

A controller receives the temperature sensor signal and a set point temperature signal encoding a set point temperature value, and provides the fuel rate signal as a function of the temperature encoded in the temperature sensor signal and the set point temperature value.

Lastly, a manually operable temperature entry device accepts human input specifying a set point temperature and provides the set point temperature signal encoding the specified set point temperature to the controller.

In one version of this invention the controller and gas valve cooperate to cycle the fuel flow rates during consecutive fixed time length intervals. I prefer to cycle fuel flow rates between high and low levels so that a flame is always present rather than between a high flow rate and zero flow. This avoids the need for an igniter or pilot light to re-ignite the flame, which may take more operating power and be less reliable as well. In the gas grill application, the constant presence of flame from a main burner is also an advantage for many foods.

In another embodiment the grill has a standing pilot burner and the low fuel flow rate is zero.

A further embodiment has a thermopile mounted to receive heat from at least one of the burner and the pilot light if present. The thermopile output is used to power the controller and the fuel valve. Using either a thermopile power source or batteries along with a LP gas tank holding the fuel allows more portability for the gas grill.

DESCRIPTION OF THE PREFERRED EMBODIMENTS

Figure 1:
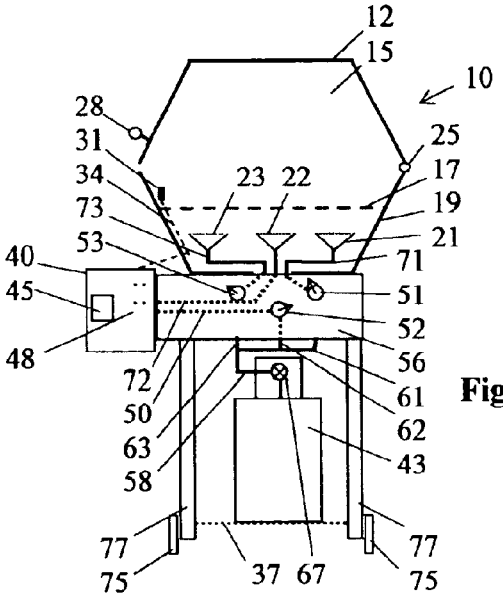
FIG. 1 is a side sketch view of a gas grill including a temperature control system.

FIG. 1 shows in a sketch view, the side of a gas grill 10 similar to that found in back yards throughout the country. A typical gas grill 10 may be perhaps 24 in. (61 cm.) wide (normal to the view of FIG. 1) and 18 in. (46 cm.) deep (horizontal dimension of grill 10 as shown in FIG. 1), although the dimensions may vary substantially from these. Grill 10 has a cooking space or enclosure 15 formed within a shell-like base portion 19 and cover 12. A hinge 25 allows the cover 12 to be pivoted clockwise as shown in FIG. 1 to open the grill 10 to provide access to the cooking space. Food to be cooked is placed on a grate 17 mounted within cooking space 15. A handle 28 allows cover 12 to be opened without burning the chef's hand.

A frame comprising a deck 56 and four legs 77 (only two being shown in FIG. 1) supports base portion 19. Wheels 75 attached to bottom ends of two of the legs 77 allow the entire grill 10 to be easily rolled from one place to another. A bracket 37 supports a fuel tank 43 usually of the type containing LP (propane) gas. Bracket 37 is shown in FIG. 1 in a simplified form as a horizontal shelf or surface supporting tank 43. In most designs, bracket 37 comprises a hanger support from which tank 43 is suspended. In many designs, bracket 37 incorporates a weight-sensing scale with an indicator showing the amount of fuel remaining in tank 43.

Figure 3:
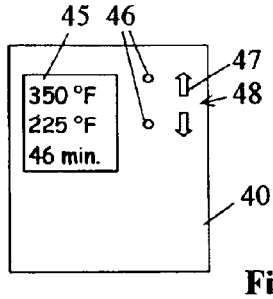
FIG. 3 shows a simple format for a control panel of the grill temperature control system.

Referring to both FIGS. 1 and 3, tank 43 has a standard integral shutoff valve 67. A main fuel line 64 has a standardized threaded male coupling or fitting 57 that threads into a standardized female coupling on tank 43 to allow fuel to flow into main fuel line 64. Main fuel line 64 connects tank 43 to a main pressure regulator 65 that provides fuel at relatively constant pressure from tank 43 to manual fuel valves 51, 52, 53 through a manifold line 58 and branch fuel lines 61, 62, 63 respectively. Manual valves 51, 52, 53 have individual knobs that are the only parts of these valves shown in FIG. 1.

Figure 2:
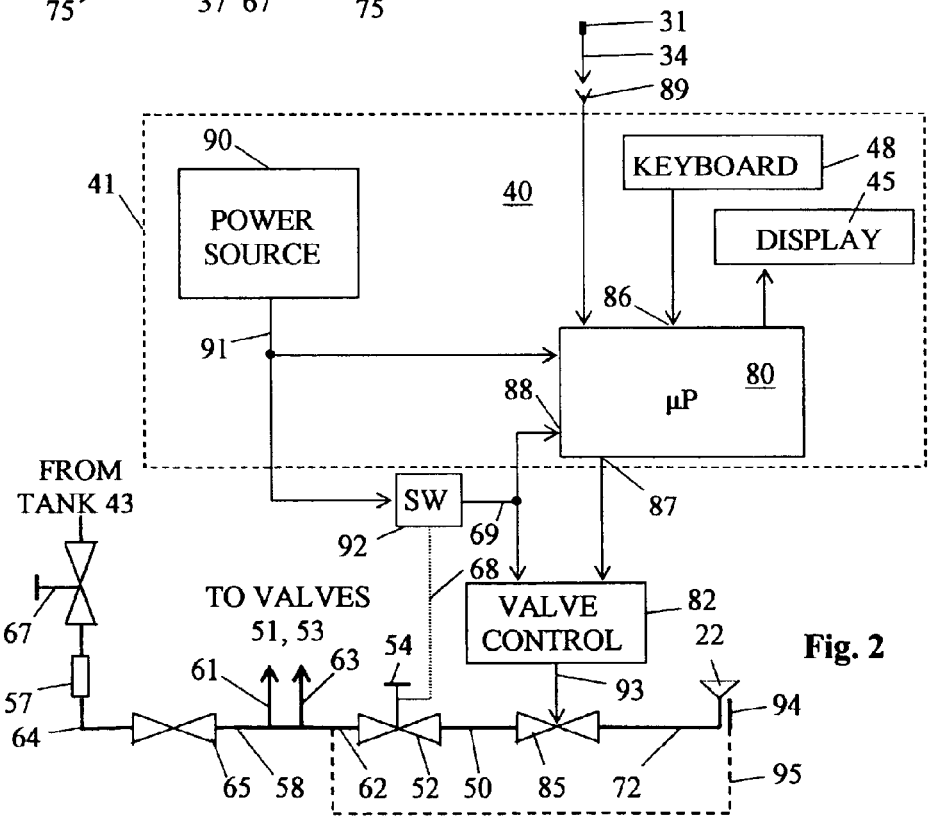
FIG. 2 is a block diagram of the temperature control system.
Figure 4:
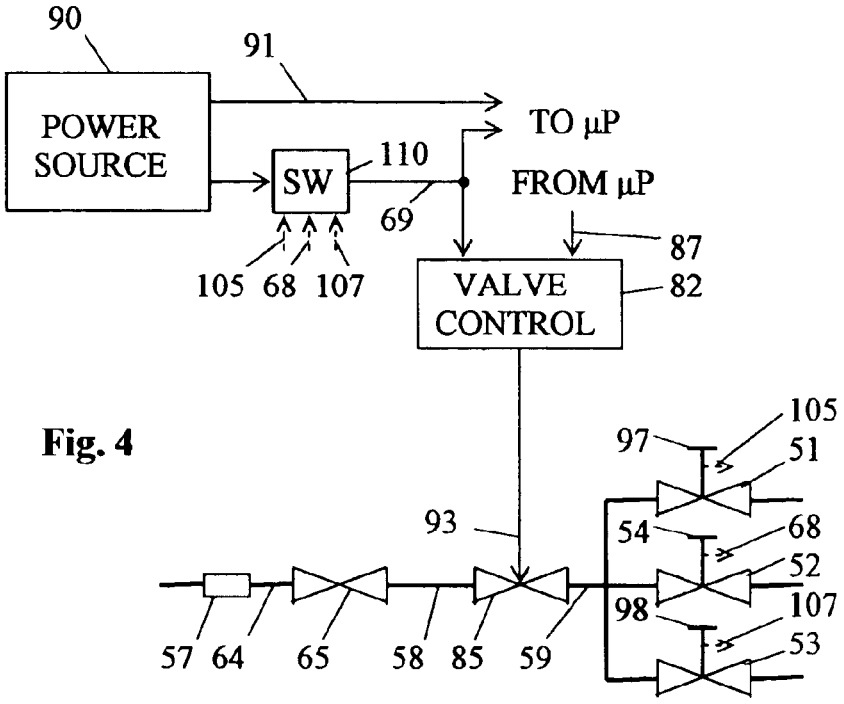
FIG. 4 is an alternative version of the temperature control system.

Manual fuel valves 51, 52, 53 are shown as mounted on a surface of deck 56. In some installations, this surface is vertical as shown but can also be slanted or horizontal. For ease of disclosure, the valves 51, 52, 53 are shown mounted on the side of grill 10, a location that would likely be inconvenient for a consumer version. In FIG. 2, valve 52 is shown as having a control knob or handle 54, and of course valves 51 and 53 have similar knobs 97 and 98 (as can be seen in FIG. 4).

Burners 21 and 23 are connected to manual valves 51 and 53 by burner lines 71 and 73 respectively. The amount of fuel flowing to burners 21 and 23 is adjusted by changing the setting of valves 51 and 53. As valves 51 and 53 are closed further, the pressure drop through them increases and less heat is produced by the reduced fuel flow through them to the burners 21 and 23.

To this point, the described gas grill structure is commonplace.

Referring to FIGS. 1–3, grill 10 includes a control system 40 for controlling temperature within enclosure 15. Typically, a grill 10 will be designed to operate in either temperature control mode or in normal mode. In temperature control mode, control system 40 can control either internal food temperature or air temperature of enclosure 15.

A housing 41 shown in outline in FIG. 2 mounts and protects control system 40. Control system 40 includes a display unit 45 for indicating performance information such as cooking space 15 temperature, selected or set point temperature, timer information if one is included in the system, etc. A keyboard or touchpad 48 allows user inputs to the system 40.

The physical structure of the invention is shown in the block diagram of FIG. 2. A small microprocessor 80 receives operating power from a DC power source 90. Being electrically powered, and given the typically hostile environment of a gas grill, I strongly prefer that the entire control system 40 be weatherproofed.

FIG. 3 shows possible features of a control panel of housing 41 in which display unit 45 and keyboard 48 are mounted. Display 45 may be any convenient type of low power unit such as a LCD unit showing set point and actual measured temperatures and a relevant time value. Keyboard 48 includes temperature control keys comprising up/down switches 47 for selecting numeric values, and control switches 46 of various kinds for turning control system 40 on and off, for setting modes of operation, etc.

In one arrangement, I use a single one of the burners, burner 22, for temperature control. I find that for some grill designs, a properly modulated burner 22 is by itself fully adequate to provide sufficient heat to hold enclosure 15 within the 100° to 500° F. range providing for baking, cooking and warming. Valve 52 should be set to a standard position or setting indicated on the valve scale when grill 10 is to operate in controlled temperature mode. The other valves 51 and 53 should be closed.

In fact, when applying this invention to an existing gas grill design, the problem is often too much heat output from a single burner 22 for maintaining lower baking temperatures. One solution to this problem is to open cover 12 slightly during controlled temperature operation. Because of the wasted fuel however, I prefer a burner 22 whose heat output can with cover 12 closed, be reduced to reliably sustain a flame maintaining an enclosure 15 temperature as low as 100–200° F. in all conditions to allow for warming and slow cooking usage of various types.

Fuel flows from tank 43 through a manual safety valve 67 to a coupling 57. Coupling 57 is used to attach and detach tank 43 from a main fuel hose 64. Hose 64 connects coupling 57 to a pressure regulator 65. Regulator 65 is a standard component that reduces the high-pressure fuel in tank 43 to a low pressure suitable for directly applying to the valves 51, 52, 53. Regulator 65 supplies low pressure fuel to main fuel line 58, from which fuel is distributed to each of the manual fuel valves 51, 52, 53.

From manual fuel valve 52, branch line 50 carries fuel to a flow control valve 85 forming a part of controller 40. Burner line 72 carries fuel from flow control valve 85 to burner 22. I prefer that valve 85 has a regulator mechanism active while the first preselected fuel flow rate exists.

Flow control valve 85 operates to further reduce pressure and rate of fuel flow to burner 22. A valve control element 82 responds to a fuel rate signal provided at an output port 87 of microprocessor 80 and power for operating control valve 85 on conductor 69 to provide a valve operating voltage on conductor 93 to control the pressure drop and flow rate of fuel through control valve 85. In one embodiment, control valve 85 has two states, one providing little change in flow rate responsive to a first voltage on conductor 93, and another substantially reducing the flow rate of fuel through valve 85 when a second voltage on conductor 93.

The Munsterhuis design mentioned earlier is suitable for flow control valve 85. The Munsterhuis design has an internal valve element that can assume either of two different spacings from the cooperating valve seat. The two valve 85 element spacings allow either a first, lower preselected fuel flow rate responsive to a first value of a valve operating voltage carried on path 93, or a second fuel flow rate higher than the first preselected fuel flow rate responsive to a second value of a valve operating voltage on path 93.

For efficient power use, the second valve operating voltage may be 0 v., requiring valve 85 to draw power only while in the low fuel flow state. The reason for this is that a typical grill 10 may often operate without the temperature control mode of this invention active, during which time valve 85 should default to the high fuel flow state. Thus, valve 85 will draw power only when in the temperature control mode, and then only when in the low flow state.

Valve 85 receives operating power from a low voltage power source 90 that may comprise no more than three series-connected 1.5 v. DC dry cells to avoid the need for line power to operate the control system. Using batteries for operating power means that flow control valve 85 must be designed to operate on a small amount of power.

I prefer that microprocessor 80 be able to operate reliably when sharing the low voltage power source 90 with valve 85. This simplifies the power requirements of the entire temperature control system.

Figure 5:
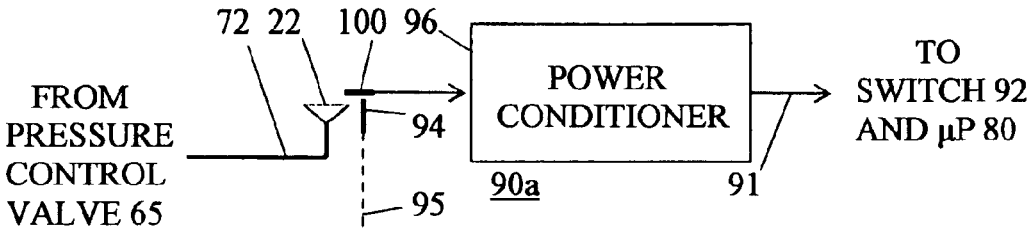
FIG. 5 shows a power source having a thermopile for supplying power for operating the temperature control system.

FIG. 5 shows an alternative power source 90*a* to the battery-based power source 90 of FIG. 2. Power source 90*a* comprises a thermopile 100 and a power conditioner 96. Thermopile 100 is mounted within cooking space 15 to receive heat provided by flame supported by burner 22 or a flame sustained by a pilot burner 94. Power conditioner 96 converts the thermopile 100 current to power with adequate voltage for operating microprocessor 80. With either power source, the servo valve feature of the Munsterhuis design provides for very small operating power requirements for valve 85. Such a thermopile 100 should be mounted with the hot junction within space 15 so as to receive heat from flames provide by at least one of the burners 21, 22, 23, or from pilot burner 94 if present.

A temperature sensor 31 is located in space 15 as shown in FIG. 1 and provides a temperature signal indicating a temperature within enclosure 15. A cable 34 carries the temperature signal from sensor 31 to a sensor port 89 connected to microprocessor 80. Sensor 31 may be any of a variety of devices, such as a thermocouple or thermistor.

One type of temperature sensor 31 may be mounted on a wall defining space 15 as shown in FIG. 1 to sense actual air temperature in space 15. Another type of sensor 31 may comprise a probe to be inserted in food such as meat to indicate the actual food temperature, which temperature of course may be substantially different from the air temperature within space 15.

In one version of this invention, either of these two different types of sensor 31 can be plugged into sensor port 89 mounted in housing 41. Each of the different types of sensor 31 has a jack connected to cable 34 for plugging into port 89. Each type of sensor 31 should have a cable 34 sufficiently long to allow the sensor to reach the desired sensing location. Cable 34 should in any case be constructed to resist the temperature and mechanical stresses arising from normal usage in the grill environment.

The keyboard or touchpad 48 of controller 40 shown in FIG. 3 accepts human input for selecting normal or temperature control mode, and the type of temperature sensor 31 to use. For example one of the switches 46 can alternate between these two modes and indicate the mode selected in display 45. Up/down switches 47 allow the chef to select a set point temperature for a particular cooking project. If controller 40 includes cooking time control, the display unit 45 may also show remaining cooking time. One of the switches 46 may allow up/down switches 47 to select cooking time.

The display unit 45 in FIG. 3 shows set point temperature, sensed temperature, and a timer value. Of course, display unit information, error conditions, etc. can also be shown. Choosing the information to be shown by display unit 45 and how it is shown is a detail beyond the scope of this description.

As mentioned, for accurate temperature control, manual valves 51–53 should be set to preselected positions. In one arrangement, this position is with valve 52 wide open and valves 51 and 53 closed. In FIG. 2, valve 52 is shown with a control knob 54. To insure that valve 52 is properly adjusted, a switch 92 is interposed between power source 90 and valve control 82. Switch 92 is connected to or operated by knob 54 by any convenient kind of a mechanical linkage or connection 68. Switch 92 is in controlling relation to fuel valve 85 in that switch 92 controls power for operating valve 85. When knob 54 is set to the preselected position, linkage 68 closes switch 92 to connect power source 90 to valve control 82 through conductor 69. In other positions for valve 52, switch 92 is open and valve 85 cannot be set to the low flow rate position.

Turning to FIG. 4 briefly, the apparatus therein conditions flow of power to valve control 82 with a switch 110 having a control position that in this example corresponds to switch 110 being closed. Valves 51–53 have respectively, control knobs 97, 54 (as in FIG. 2), and 98 and receive fuel from valve 85 through a line 59. When valves 51 and 53, are closed for example, and valve 52 is wide open, then all of the valves 51–53 are set in preselected positions. When all of the valves 51–53 are in the preselected positions, mechanical linkages 105, 68, and 107 respectively cause switch 110 to close, entering the control position. When in the control position, switch 110 allows power to flow to valve control 82 and valve 85.

Turning again to FIG. 2, a typical microprocessor 80 will not have adequate power handling to directly provide the valve 85 operating voltage. Valve control element 82 is controlled by microprocessor 80 to switch the operating voltage to valve 85. Power flowing through switch 92 is switched by control element 82. Microprocessor 80 provides a fuel rate signal on port 87 that controls the status of valve control element 82. Valve control element 82 may be a relay or electronically operated switch such as a transistor.

Microprocessor 80 has a number of I/O ports for communicating with the temperature sensor 31, keyboard 48, display 45, and valve control element 82. Any of the small, low power drain microprocessors available from a number of different vendors will be suitable for the purpose. The processing and memory requirements are relatively low, so power requirements and ruggedness are probably the more important considerations in choosing a suitable microprocessor design.

When operating in temperature control mode, an input port 86 of microprocessor 80 receives a set point temperature signal from keyboard 48 and a temperature signal from temperature sensor 31. The temperature signal from sensor 31 will most likely be an analog value requiring conversion to digital format, which is a common function available in hardware, software, or a combination of the two implemented in microprocessor 80. As described above, microprocessor 80 provides signals to display unit 45 to display the various operating parameters mentioned above. Those familiar with microprocessor programming can easily devise suitable software to implement these various functions.

Microprocessor 80 also receives the voltage switched by switch 92 at an input port 88. Microprocessor 80 frequently senses the status of switch 92 and operates in temperature control mode operation only when an operating voltage is sensed at port 88.

Microprocessor 80 implements the various functions of the temperature control mode (although microprocessor 80 in this embodiment cannot shut off grill 10). Generally, microprocessor 80 alternates valve 85 between the low and high fuel flow states to hold the temperature sensed by sensor 31 close to the set point value.

An alternative design is shown by dotted line fuel line 95 spliced into manifold fuel line 58. Fuel line 95 provides power to a pilot burner 94. When safety valve 67 is opened and burner 22 ignited, pilot burner 94 ignites as well. In this variation, valve 85 can change between open and closed states, since pilot burner 94 sustains flame during times when valve 85 is closed. However, pilot flame reignition may not be as reliable as modulating from a low flow to a high flow state for valve 85. That is, for one reason or another, pilot burner 94 may not sustain flame or may otherwise fail to ignite burner 22. Since the intention is for system 40 to operate untended for periods of time, use of a pilot burner 94 may require continuous flame sensing for safety. Flame sensing adds additional power requirements and cost to system 40, so pilot ignition may be less desirable than modulated flow for valve 85.

Microprocessor 80 needs a suitable temperature control algorithm for providing the fuel rate signal at terminal 87. Many temperature control algorithms are available. There are a number of factors to consider when selecting one of these many algorithms for controlling grill temperature. Since it is likely the available power for operating valve 85 is low, the algorithm should minimize the power drawn by valve 85. Efficient fuel use and fast recovery when cover 12 is lifted are other factors to use in selecting a suitable algorithm. Temperature control accuracy of 5–10° F. should usually be adequate for the purposes of the invention.

To date, no specific algorithm appears to be a strong favorite over all others. The pseudocode listing in the Appendix defines one algorithm I believe is suitable.

Generally, microprocessor 80 in executing object code defined by the pseudocode listing defines successive 30 sec. control intervals. By controlling the length of time valve 85 is in the high fuel flow rate state during a control interval relative to the (remaining) length of time in the interval during which valve 85 is in the low fuel flow rate, the sensed temperature can be changed to match the set point temperature.

In explaining the Appendix pseudocode listing, I should point out that no universally accepted pseudocode syntax exists. I am not aware of compilers for translating pseudocode directly to object code. However, pseudocode is widely accepted as a way to accurately describe software programs of many types. Pseudocode is intuitive and so close to many compiler languages that those with even average skill in the art can easily translate a pseudocode listing into a source code syntax suitable for compiling into object code.

This object code can be loaded into program memory of microprocessor 80. When microprocessor 80 executes this object code, the microprocessor briefly becomes functional hardware elements performing the function defined by the pseudocode statement. In this way, the pseudocode can accurately be considered to define a group of hardware elements that sequentially come into existence as the object code is executed.

The functional hardware elements created by the executing object code also generate electrical data signals. One example of such signals is the fuel rate signal on output port 87, but the microprocessor 80 generates many other internal and external signals as a consequence of executing the object code.

Pseudocode listings comprise a series of action statements, each specifying a particular computer activity. Each action statement in the Appendix listing may be preceded with text explaining on one or more lines the purpose of the action statement. Each explanatory text line starts with a "'"symbol.

Most action statements include one or more variables. These may be defined simply by their initial usage or as in the listing, by a variables list. For purposes of this particular pseudocode listing, variables may be considered to be short (8 or 16 bit for example) signed integral values. Variable values defined by arithmetic operations may be rounded if necessary to fit within the memory elements involved. The need to scale variables is well known and need not be discussed.

The listing has several different types of action statements. A command is one or more in-sequence microprocessor instructions that perform the specified function. A routine is one or more in-sequence microprocessor instructions that perform the specified function, and is designed for access by a call command. The use of routines allows a particular function to be performed by a single set of instructions, and reduces the amount of instruction memory required by the program.

Equation commands include an equal sign indicating that the variable beginning the statement is to be set to the value specified by the operation or variable value following the equal sign. Of course, the various arithmetic operators have their normal meanings.

An 'if' command performs the indicated test of the specified values and if the test is satisfied, performs the action(s) specified by the 'then' operator. If the test is not satisfied, execution continues with the next command in the listing.

A 'call' command specifies execution of the named routine, and then return of execution to the command immediately following the call command. Listing the individual commands in these called routines is not shown when the function of the routine is explained by the name and the function is well known or easy to program. A call command may include one or more parenthetically listed operators that indicate input values provided to the called routine or variables whose values are to set by the called routine. The following routines are the subject of call commands in the pseudocode listing.

The 'limit' routine operates to limit the value of the first named variable to the range established by the second and third named variables. If the first named variable value is smaller than the second named variable value the first named variable value is set to the second named variable value. If the first named variable value is larger than the third named variable value the first named variable value is set to the third named variable value. Otherwise the first named variable value is left unchanged.

The 'read' routine accesses the first-named input port to read the current data value at the port and store the data value in the second-named variable. The read routine requires A/D conversion of the value at the port. The data resolution provided by port 89 should be at least 10 bits, since the sensed temperature range is approximately 400° F. and 0.5° F. resolution is desirable. Data resolution for voltage at port 88 may be 6–8 bits, since only a few tenths of a volt need be resolved.

The 'set' routine is similar to the read routine, and provides the specified data (second parenthetical value) to the output port specified as the first parenthetical value.

With these explanations, one of average skill in microprocessor programming should be easily able to understand the functions by which the pseudocode algorithm controls the setting of valve 85.

The microprocessor 80 is designed to start executing the main_loop instructions when power is first applied. For convenient reference, each line of pseudocode is numbered.

Lines 1–16 preset the specified variables to preferred values. These values show that the run_control_algorithm executes every 30 sec., the run_cycler routine every 300 ms., and the check_inputs routine runs every 100 ms. Obviously, these values can be changed to suit the product requirements, speed of microprocessor 80, etc.

Lines 17–34 call the software routines run_control_algorithm, run_cycler, and check_inputs. The timing of this section is controlled by the Delay1Ms routine. This function can be implemented using timer hardware in the microprocessor or it can be a simple software delay loop. If it is a simple software delay loop the execution times of the other tasks must be considered to obtain acceptable timing accuracy.

The run_control algorithm task defined by lines 35–43 executes in a few milliseconds. The line 35 command reads the temperature sensed by sensor 31, converts the value to digital format, and stores the digital value in the grill_temperature variable.

The line 37 command calculates the error. The user controls the 'setting' value with up/down switches 47, see line 53. The lines 38–39 commands calculate an integral control value. The lines 40–41 commands calculate a proportional control value. The line 42 command calculates a duty_cycle value based on the integral and proportional control values. If the control interval, control_dt=30 sec. and cycler_resolution=100, the duty_cycle value is the number of 300 ms. intervals that valve 85 will have the low flow state. The cycler_resolution=100 means that each unit value of the duty_cycle is 1% of the total control interval.

The run_cycler task operates every 300 ms. and controls the flow level of valve 85. The lines 47–48 commands set valve 85 to low or high flow depending the value of the 'counter' and duty_cycle variables. The run_cycler task is executed every 300 ms., at which time the line 34 command increments the 'counter' value. When the 'counter' value becomes larger that the duty_cycle value, then line 47 causes microprocessor 80 changes the setting of port 87, which changes the setting of valve 85 from high flow to low flow.

The check_inputs task reads the various inputs needed to implement temperature control. Line 53 handles the user input that change the 'setting' value. Line 54 reads the sensor 31 output stored in the grill_temperature variable. Line 55 actually displays the current grill temperature on display unit 45.

As mentioned, proper and safe operation requires valve 52 to be set to a preselected position. Lines 56 and 57 sense the position of the knob 54 that controls valve 52, and if not proper, prompts user to set the grill knob. Also, line 44 and 45 forces valve 85 to high flow, to prevent the possibility of a flameout caused by too low pressure when the grill knob 54 is not in the proper position.

FIG. 5 shows an alternate power source 90*a* using a thermocouple 100. In FIG. 5, thermocouple receives power from pilot burner 94, but power can also be derived directly from burner 22, when pilot burner 94 is not present. Because of the smaller voltage typically available from thermocouples presently in use, a power conditioner 96 is necessary to provide power at path 91 adequate for operating microprocessor 80 and possibly valve 85 as well.

APPENDIX--PSEUDOCODE SOFTWARE LISTING

```
begin comment block
Variable definitions:
control_dt
   is the interval between successive executions of the control algorithm;
   the default is 30 sec.; recommended range is 1–60 sec.
cycler_resolution
   is the number of divisions of one control_dt interval at which
   the setting of valve 85 can be changed; the default is 100; the value
   should be greater than 10
cycler_dt
   is the time interval at which the cycler runs, calculated as:
   cycler_dt = control_dt/cycler_resolution
counter
   is used to control the cycler
grill_temperature
   is the current grill temperature requested by the user with keyboard 48
hysteresis
   is used to stabilize cycling of valve 85
grill_temperature
   is the current set point temperature selected by the user with
   keyboard 48
ki
   is the integral gain constant; the default is 0.01; suggested range
   is from 0 to 10
kp
   is the proportional gain constant; the default is 1; suggested range is
   from 0 to 10
setting
   is the control set point adjustable by user to desired cooking or baking
   temperature; default is 350° F.; suggested range is from 150° F.
   to 500° F.
integral
   is the current integral control value
control
   is the current combined proportional and integral control value
integral_max
   the upper limit placed on the integral value; the default is 3
integral_min
   the lower limit placed on the integral value; the default is −3
control_max
   the upper limit placed on the control value; the default is 3
control_min
   the lower limit placed on the control value; the default is 0
switch_voltage
   the voltage provided by switch 92 to port 88
power_voltage
   the minimum power voltage for safe operation of grill 10
sample_interval
   the time in milliseconds between successive samplings of the
   specified port; default is 100
end comment block
begin main_loop 'for temperature control mode
   'initialize variables
      1) cycler_resolution = 100
      2) control_dt = 30000
      3) sample_dt = 100
      4) cycler_dt = control_dt/cycler_resolution
      5) ki = 0.01
      6) kp = 1
      7) hysteresis = 5
      8) setting = 350
      9) integral = 0
      10) counter = 0
      11) mode_flag = 1
      12) power_voltage = 4.0
      13) sample_interval = 100
      14) control_timer = 1
      15) cycler_timer = 1
      16) sample_timer = 1
'schedule tasks using below do loop
      17)do
      18) call Delay1Ms
      19) control_timer = control_timer − 1
      20) if control_timer = 0 then
```

-continued

APPENDIX--PSEUDOCODE SOFTWARE LISTING

```
    21)   call run_control_algorithm
    22)   control_timer = control_dt
    23) endif
    24) cycler_timer = cycler_timer-1
    25) if cycler_timer = 0 then
    26)   call run_cycler
    27)   cycler_timer = cycler_dt
    28) endif
    29) sample_timer = sample_timer - 1
    30) if sample_timer = 0 then
    31)   call check_inputs
    32)   sample_timer = sample_dt
    33) endif
    34)loop
end main_loop
begin run_control_algorithm 'every control_dt seconds
  'get a new reading from temperature sensor 31
    35) call read port 89 (grill_temperature)
  'reset the 'counter' value for the run_cycler task to 0
    36) counter = 0
  'calculate temperature error from desired set point
    37) error = setting - grill_temperature
  'calculate integral control value
    38) integral = integral + ki * control_dt * error
  'limit integral value range
    39) call limit ( integral, integral_min, integral_max)
  'calculate proportional control value plus integral value
    40) control = kp * error + integral
  'limit control value range
    41) call limit ( control, control_min, control_max )
  'calculate valve 85 high/low duty cycle
    42) duty_cycle = control * cycler_resolution/
    ( control_max - control_min )
    43) return
end run_control_algorithm
begin run_cycler 'every cycler_dt seconds
  'counter is used to measure time that port 87 output = 0 to set state
  'of valve 85 to low flow value
    44) if switch_voltage < power_voltage then
    45)   call set (port 87, 1)
    46) else
    47)   if counter >= duty_cycle then call set (port 87, 0)
  'add hysteresis value to prevent short cycling; measure time to set port
  '87 = 1 to set state of valve 85 to high flow value
    48) if counter < ( duty_cycle - hysteresis ) then call set (port 87, 1)
  'update the counter and reset to 0 if greater than cycler_resolution
    49)   counter = counter + 1
    50)   if counter >= cycler_resolution then counter = 0
    51) endif
    52) return
end run_cycler
begin check_inputs 'every sample_interval
  'read user input and update set point, read sensed temperature, and
  'display current temperature
    53) call read (port 86, setting)
    54) call read (port 89, grill_temperature)
    55) call display (grill_temperature)
  'check for proper position of manual valve 52 and disable lower
  'flow level of valve 85 and display error if incorrect
    56) call read (port 88, switch_voltage)
    57) if switch_voltage < power_voltage then display (set manual
    valve) return
end check_inputs
```

I claim:

1. A control system for a fluid fuel burner supplying heat to an enclosure, said system including:

a) a temperature sensor mounted within the enclosure for sensing the temperature within the enclosure and providing a temperature signal encoding the temperature within the enclosure;

b) a first fuel valve for controlling flow of fuel from an inlet port to the fuel burner, and having at least first and second preselected fuel flow rates responsive to first and second states of a fuel rate signal respectively, said second fuel flow rate higher than the first fuel flow rate, said first fuel valve including a regulator mechanism active while the first preselected fuel flow rate exists;

c) a controller receiving the temperature sensor signal and a set point temperature signal encoding a set point temperature value, for providing to the first fuel valve the fuel rate signal having the at least first and second states thereof as a function of the temperature encoded in the temperature sensor signal and the set point temperature value; and d) a keypad functioning as a manually operable temperature entry device accepting human input specifying a set point temperature and providing a set point temperature signal encoding the specified set point temperature.

2. The control system of claim 1, wherein the keypad includes a temperature control key for specifying a temperature input from the keypad, and wherein the controller records the temperature input from the keypad as the set point temperature value responsive to operation of the temperature key.

3. The control system of claim 1 wherein the temperature sensor comprises a meat probe.

4. The control system of claim 1, wherein the first fuel valve has a first preselected fuel flow rate greater than zero flow.

5. A control system for a fluid fuel burner supplying heat to an enclosure, said system including:

a) a temperature sensor mounted within the enclosure for sensing the temperature within the enclosure and providing a temperature signal encoding the temperature within the enclosure;

b) a first fuel valve for controlling flow of fuel from an inlet port to the fuel burner, and having at least first and second preselected fuel flow rates responsive to first and second states of a fuel rate signal respectively, said second fuel flow rate higher than the first fuel flow rate, said first fuel valve including a regulator mechanism active while the first preselected fuel flow rate exists;

c) a controller receiving the temperature sensor signal and a set point temperature signal encoding a set point temperature value, for providing to the first fuel valve the fuel rate signal having the at least first and second states thereof as a function of the temperature encoded in the temperature sensor signal and the set point temperature value, wherein the controller comprises a proportional control function and an integral control function; and d) a manually operable temperature entry device accepting human input specifying a set point temperature and providing a set point temperature signal encoding the specified set point temperature.

6. The control system of claim 5, wherein the controller comprises a run control calculator determining for intervals a duty cycle value specifying a fraction of the interval, and including a run cycler providing one value of the fuel rate signal during the duty cycle fraction of the interval and the other fuel rate value during at least part of the remainder of the interval.

7. The control system of claim 6, wherein the first fuel valve has a first preselected fuel flow rate greater that zero flow.

8. In a gas grill of the type having a cooking enclosure, a fitting for connecting to a gas fuel source, a burner in the cooking enclosure, and a fuel line to conduct fuel from the fitting to the burner, the improvement comprising:

a) a temperature sensor mounted within the cooking enclosure for sensing a temperature within the enclosure and providing a temperature signal encoding the temperature within the enclosure;

b) an electrically controlled fuel valve interposed in the fuel line for controlling flow of fuel from the fitting to the fuel burner, and having at least first and second preselected fuel flow rates responsive respectively to first and second states of a fuel rate signal, said second fuel flow rate higher than the first fuel flow rate, said fuel valve including a pressure regulator mechanism active while the first preselected fuel flow rate exists;

c) a controller receiving the temperature sensor signal and a set point temperature signal encoding a set point temperature value, for providing the fuel rate signal as a function of the temperature encoded in the temperature sensor signal and the set point temperature value, said controller including i) a timer providing a clock signal at the start of each of a series of consecutive time intervals of preselected length; and ii) an algorithm processor receiving the clock signal, the set point temperature and the temperature signal, and responsive to each clock signal providing the first value of the fuel rate signal for a fraction of the preselected time interval length as a function of the set point signal and the temperature signal, and the second value of the fuel rate signal for the remaining fraction of the preselected time interval length; and d) a manually operable data entry device accepting human input specifying a set point temperature and providing a set point temperature signal encoding the specified set point temperature.

9. The improvement of claim 8, including a battery supplying operating power to the fuel valve.

10. The improvement of claim 8, wherein the entry device comprises a keypad.

11. The improvement of claim 10, wherein the keypad includes a temperature key for specifying a temperature input from the keypad, and wherein the controller records the temperature input from the keypad as the set point temperature value responsive to operation of the temperature key.

12. The improvement of claim 8 wherein the temperature sensor comprises a meat probe.

13. The improvement of claim 8, including a thermopile mounted to receive heat from the burner and supplying power to the controller and the valve.

14. The improvement of claim 13, including a pilot light receiving fuel from the fuel line, and mounted adjacent to the burner and the thermopile, and wherein the first fuel valve shuts off fuel flow when receiving the first state of the fuel rate signal.

15. In a gas grill of the type having a cooking enclosure, a fitting for connecting to a gas fuel source, a burner in the cooking enclosure, and a fuel line to conduct fuel from the fitting to the burner, the improvement comprising:

a) a temperature sensor mounted within the cooking enclosure for sensing a temperature within the enclosure and providing a temperature signal encoding the temperature within the enclosure;

b) an electrically controlled fuel valve interposed in the fuel line for controlling flow of fuel from the fitting to the fuel burner, and having at least first and second preselected fuel flow rates responsive respectively to first and second states of a fuel rate signal, said second fuel flow rate higher than the first fuel flow rate;

c) a controller receiving the temperature sensor signal and a set point temperature signal encoding a set point temperature value, for providing the fuel rate signal as a function of the temperature encoded in the temperature sensor signal and the set point temperature value;

d) a manually operable data entry device accepting human input specifying a set point temperature and providing a set point temperature signal encoding the specified set point temperature;

e) at least one manually operable second fuel valve in series with the first fuel valve, said second fuel valve for manually controlling fuel flow to the burner, said second fuel valve having a control knob for controlling the flow rate of fuel through the valve; and f) a switch having a mechanical linkage to the second fuel valve's control knob, said switch in controlling relation to the first fuel valve, said mechanical linkage placing the switch in a control position when the knob is in a predetermined position, said switch when in the control position allowing the first fuel valve to reach at least both of the first and second fuel flow rates, and allowing only the second fuel flow rate for the first fuel valve otherwise.

16. The improvement of claim 15, wherein the gas grill includes at least two burners and two manually operable second fuel valves, each second fuel valve in series with the first fuel valve and each controlling fuel flow to a preselected one of the burners, each said second fuel valve having a control knob for controlling the flow rate of fuel through the associated second fuel valve, wherein the improvement further comprises for each second fuel valve, a switch having a mechanical linkage to the second fuel valve's control knob and in controlling relation to the first fuel valve, said mechanical linkage placing the switch for each second fuel valve in a control position when the knob for each of the second fuel valves is in a predetermined position for that second fuel valve, said switch for each second fuel valve when in the control position allowing the first fuel valve to reach at least both of the first and second fuel flow rates, and allowing only the second fuel flow rate for the first fuel valve otherwise.

* * * * *